US006531787B2

(12) United States Patent
Koelle et al.

(10) Patent No.: US 6,531,787 B2
(45) Date of Patent: Mar. 11, 2003

(54) STARTER DEVICE FOR AN INTERNAL COMBUSTION ENGINE

(75) Inventors: Gerhard Koelle, Wiernsheim (DE); Simon-Florian Czerny, Markgroeningen (DE); Manfred Ackermann, Oppenweiler (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/049,543

(22) PCT Filed: Jun. 9, 2001

(86) PCT No.: PCT/DE01/02164

§ 371 (c)(1),
(2), (4) Date: Jun. 3, 2002

(87) PCT Pub. No.: WO01/96735

PCT Pub. Date: Dec. 20, 2001

(65) Prior Publication Data

US 2002/0163197 A1 Nov. 7, 2002

(30) Foreign Application Priority Data

Jun. 16, 2000 (DE) ..... 100 29 714

(51) Int. Cl.[7] ..... F02N 11/00
(52) U.S. Cl. ..... 290/31; 290/38 R; 123/179.3
(58) Field of Search ..... 290/31, 36 R, 290/38 R, 40 R, 40 A, 40 B, 40 C, 46, 47, 48; 123/179.3

(56) References Cited

U.S. PATENT DOCUMENTS

| | | | | |
|---|---|---|---|---|
| 5,495,127 A | | 2/1996 | Aota | 290/31 |
| 5,970,937 A | * | 10/1999 | Casellato et al. | 123/179.3 |
| 5,983,850 A | * | 11/1999 | Vilou | 123/179.3 |
| 6,024,065 A | * | 2/2000 | Hojna et al. | 123/179.3 |
| 6,050,233 A | * | 4/2000 | Vilou | 123/179.3 |
| 6,054,826 A | | 4/2000 | Murakami et al. | 318/471 |
| 6,093,974 A | * | 7/2000 | Tabata et al. | 290/40 R |
| 6,365,983 B1 | * | 4/2002 | Masberg et al. | 290/40 C |

FOREIGN PATENT DOCUMENTS

| | | |
|---|---|---|
| EP | 0 987 434 A | 3/2000 |
| FR | 2 797 530 A | 2/2001 |

* cited by examiner

*Primary Examiner*—Nicholas Ponomarenko
(74) *Attorney, Agent, or Firm*—Michael J. Striker

(57) ABSTRACT

A starter device (1) for an internal combustion engine (2) is provided that comprises an electric starter motor (3), a power supply (16), and an activating unit (4) for the starter motor (3).

The activating unit comprises circuit-breaker electronics (6) and a control unit (5) for the circuit-breaker electronics (6).

Sensors are provided to register physical parameters relevant to the starting power of the starter motor (3) in order to adapt the start characteristic line of the starter motor (3) in optimal fashion within permissible limit values of the physical parameters.

11 Claims, 1 Drawing Sheet

STARTER DEVICE FOR AN INTERNAL COMBUSTION ENGINE

The invention concerns a starter device for an internal combustion engine having an electric starter motor as well as a power supply and an activating unit for this starter motor.

Common conventional electric starter motors are usually commutator DC motors with permanent-magnet or electrical excitation. Power is supplied via the electrical system of the vehicle outfitted with the internal combustion engine, by way of its battery.

A more or less complex switch device is generally used as the activating unit for the starter motor, which switch device is coupled to the vehicle's ignition switch and is actuated when the ignition key reaches the "ignition on" position.

Customary starter devices according to the related art now comprise a design characteristic that is tailored to the starter output at the "starting limit temperature". Since they are operated for only a short period of time, they are not designed for long-term output. Thermal overload protection is therefore unnecessary. Due to this design characteristic, known mass-produced starters are optimized in terms of cost and are tailored relatively greatly to the respective application.

It is known that starter devices are faced with conflicting requirements due to their operating conditions. One example is the "cold-start problem". The starter motor itself is required to make high mechanical output available at very low ambient temperatures, because the internal combustion engine is very difficult to turn over due to the high-viscosity lubricant and, therefore, running properties characterized by high frictional forces. This demands high starter output, which must be achieved by drawing the appropriate amount of energy from the power supply via the vehicle's battery. Especially at low ambient temperatures, on the other hand, the electrical energy available from the vehicle's battery is greatly restricted, so excessive power output demands must not be placed, in order to prevent breakdown of the battery.

Based on the problem described as an example, the invention is now based on the object of providing a starter device for an internal combustion engine that is capable of being operated in flexible fashion depending on different operating conditions in order to improve the starting conditions, in particular the starter output and starting comfort, combined with an increased service life of the starting system. It should thereby be possible, in particular, to use common starter motors in the form of least-cost, mass-produced assemblies, as before.

According to the defining part of claim 1, this object is attained by means of a characteristic design of the activating unit. Accordingly, the latter comprises circuit-breaker electronics, a control unit, the control output of which is connected to the control input of the circuit-breaker electronics, as well as sensors connected to the inputs of the control unit to register physical parameters relevant to the starting power of the starter motor. Based on the parameters registered by the sensors, the control unit thereby optimizes the start characteristic line for activating the starter motor within the limit values of the physical parameters permissible for this [starter motor]. Starter output is maximized in particular.

In summary, therefore, the start characteristic line can be controlled in such a fashion that no limit values—such as mechanical limit values in the form of the maximum speed at which the starter motor turns, thermal limit values in the form of permitted maximum temperatures of the starter motor, magnetic limit values, as characterized by the current flowing through the starter motor during the starting process, as well as electrical limit values defined by the "brush arcing" and the commutation—are exceeded.

In a preferred exemplary embodiment of the invention, the characteristic line values can then be adapted within the permissible limit values of the physical parameters to optimal parameters identified and specified for the respective starter type and certain starting scenarios.

According to further preferred embodiments of the object of the invention, temperature sensors are provided to register the temperature of the internal combustion engine and/or the starter motor as physical parameters. Moreover, in addition or as an alternative, an ammeter can be provided to register the current flowing through the starter motor during the starting process, a torque sensor can be provided to register the torque produced by the starter motor during the starting process, and/or a speed sensor can be provided to register the speed at which the starter motor turns during the starting process. Depending on the starting temperature, therefore, the characteristic line values can be limited with regard for power and adjusted depending on the temperature of the internal combustion engine, for example.

According to further preferred exemplary embodiments, the start characteristic line can be selected differently depending on various speed ranges. In the low-speed range, for example, the start characteristic line can be selected to limit starting current/torque depending on the permissible demagnetization limit of the starter motor magnets. In the middle-speed range, the start characteristic line, on the other hand, can be selected to limit starting current/torque depending on the permissible, brush arcing-induced wear values, the starter temperature, and/or the temperature of the internal combustion engine. In the higher-speed range, the start characteristic line can be selected depending on the permissible, centrifugal force-induced mechanical limit values of the starter motor.

In all optimization processes, the engine-starting sequence can preferably be registered by the control unit, and the characteristic line values can be changed, particularly in terms of improving the next starting sequence. If the engine does not start, this means that the characteristic line values are changed in terms of improving the starting process so that a repeat start is initiated using the new characteristic line values.

In summary, the object of the invention with its preferred further developments offers the following advantages compared to starter devices based on the related art:

- Power can be increased by a factor of 2 at the least.
- The increase in warm-start power in the middle speed range in particular leads to improved support as the engine runs up to speed, as well as to shorter start times and an improved starting behavior of the internal combustion engine.
- The start characteristic lines can be adapted to identified parameters that are optimal for starting.
- At cold-start temperatures, the starting energy can be reduced to protect the battery.
- Starting current spikes and, as a result, starting power spikes are prevented.
- The starter device offers an integrated, thermal, mechanical and magnetic overload protection. The number of different starter types for different vehicles and internal combustion engines can thereby be reduced—using a fixed hardware configuration—by adapting the control unit parameters to the respective vehicle data.

In general, the size of the starter devices can be reduced while retaining at least the same starter output as compared to conventional systems.

Further features, details, and advantages of the invention are provided in the following description, in which an exemplary embodiment of the object of the invention is explained in greater detail using the attached drawings.

Figure 1:
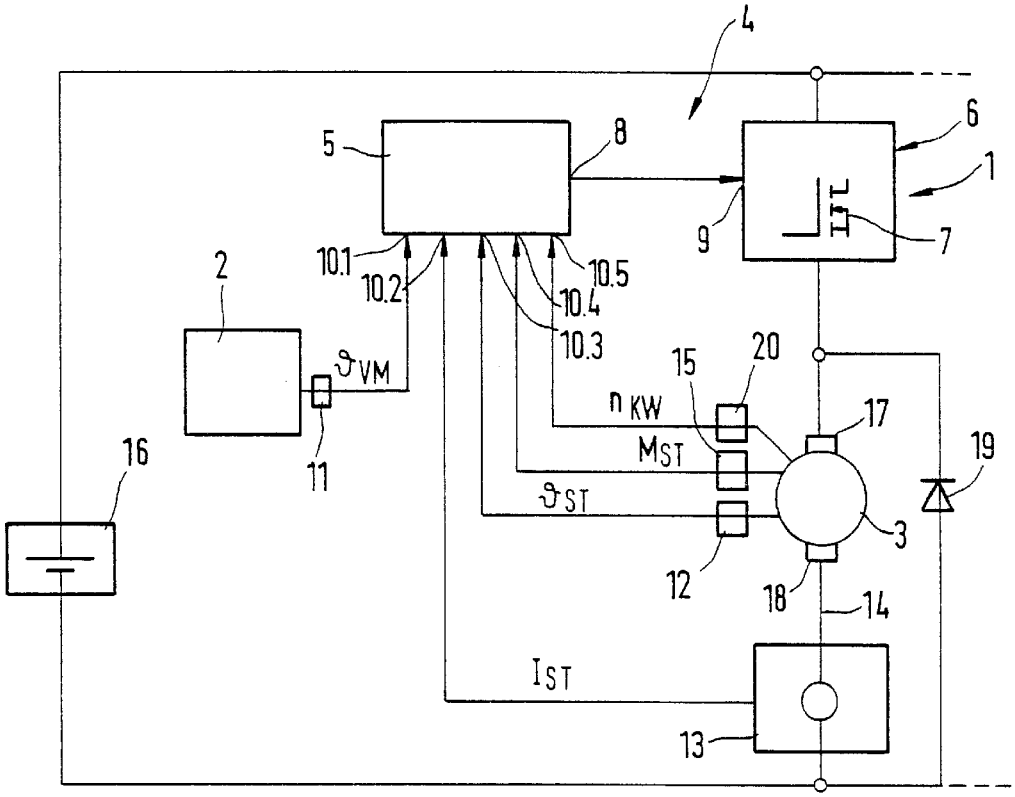
FIG. 1 shows a block diagram of a starter device.

The starter device labelled in entirety using the numeral 1 in FIG. 1 serves to start an internal combustion engine, e.g., a spark-ignition engine. The core of the starter device 1, on the one hand, is an electric starter motor 3, which can be a mass-produced assembly of the "commutator DC motor" type. Moreover, an activating unit for the starter motor 3 labelled in entirety using the numeral 4 comprises a control unit 5 and circuit-breaker electronics 6. This comprises a MOS-FET power semiconductor 7 that controls the starter motor 3 in timed fashion, as usual. The circuit-breaker electronics 6 are activated via the control output 8 of the control unit 5, which is connected to the corresponding control input 9 of the circuit-breaker electronics 6.

Various sensors 11, 12, 13, 14, 15, 20 are coupled to the various inputs 10.1 through 10.5 of the control unit 1, which serve to register physical parameters relevant to the starting power of the starter motor 3. A temperature sensor 11 is assigned to the internal combustion engine 2, for example, that provides an electrical signal $\vartheta_{VW}$ that is representative of the operating temperature of the engine 2. Likewise, a temperature sensor 12 is provided at the starter motor 3 that outputs an electrical signal $\vartheta_{ST}$ to the control unit 5 that is representative of the temperature of the starter motor 3.

An ammeter 13 is connected in series with the starter motor 3 in the branch circuit 14 to register the current flowing through the starter motor 3. This generates an electrical signal $\vartheta_{ST}$ that is representative of the flowing current 1.

Finally, a torque sensor 15 is located at the starter motor 3 that measures the torque produced by the starter motor 3 during the starting process and outputs a corresponding signal $M_{ST}$ to the input 10.4 of the control unit 5.

Figure 2:
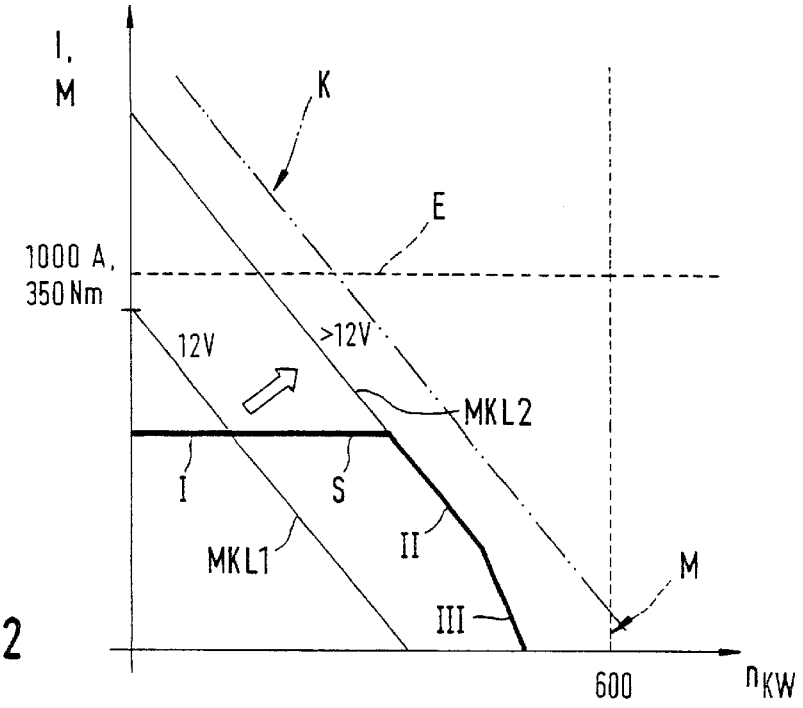
FIG. 2 shows a graph of the current and torque characteristic line of the starter device as a function of the speed at which the starter motor turns.

Moreover, the starter motor 3 is provided with a speed sensor 20 that outputs a signal at the input 10.5 of the control unit 5 that is representative of speed $n_{KW}$ As illustrated in FIG. 2, the characteristic line of the starter motor 3 is selected accordingly depending on the starter motor speed $n_{KW}$ as characteristic value.

Power is supplied to the starter motor 3 via the vehicle's battery 16, and a free-wheeling diode 19 is connected in parallel to the series circuit of the starting motor windings 17, 18 and the ammeter 13.

In this context, FIG. 2 is a diagram of the dependencies of the current I flowing through the starter motor 3 during the starting process and the torque M developed thereby as a function of speed $n_{KW}$. Various limits are also shown in the diagram. The demagnetization limit E is shown as a dashed line, for example. In terms of optimizing the activation of the starter motor and the characteristic line used for this, it should be noted with regard for the demagnetization limit E that the power of common mass-produced starters can be increased, for example, by using more powerful magnets. The maximum current—the short-circuit current—that flows through starters that are common today is avoided with the invention by activating the starter motor accordingly using a certain limiting current. The demagnetization is thereby determined by the limiting current, which can be adjusted in optimal fashion for the respective starter.

Another method of increasing power is to operate the starter at a higher voltage. No damage is caused because all relevant limit values, i.e., the demagnetization limit E in particular, can be adhered to by regulating the limiting current in suitable fashion. This is illustrated using the solid torque characteristic line MKL1 in FIG. 2 for operation using a vehicle system voltage of 12 V and the characteristic line MKL2 for operation using a vehicle system voltage of>12 V. The limiting current must be selected in every case such that the torques are ensured at the working point. This value is typically lower than the value of the short-circuit current by a factor of 2.

Moreover, the "commutation limit K" is indicated in FIG. 2 using a double-dot-dash line. The commutation limit K is determined by the maximum permissible brush arcing at the commutator. The brush arcing, in turn, is a decisive factor in the service life of the commutator. Here, as well, a maximum line can be selected via the control unit 5 in starter-specific fashion and independent of the ambient parameters.

The last relevant limit is the mechanical limit M, indicated using a dashed line. The mechanical limit M is 600 $min^{-1}$ when the starter motor 3 turns at a speed $n_{KW}$, for example. This upper speed limit is determined mainly by centrifugal force in the region of the commutator and the rotor winding head of the starter motor 3. Here, as well, the maximum values can be utilized extensively via the control at every temperature of the starter motor 3 or the internal combustion engine 2. In the case of customary starter activation, however, the permissible starter power at temperatures below zero is greatly restricted by the limit of centrifugal force when the starter is at operating temperature, for example.

A representative desired characteristic line S selected by the control unit 5 is indicated in the diagram in FIG. 2 using a bold line. It shows clearly that, in a low speed range, the start characteristic line is selected to limit starting current/torque depending on the permissible demagnetization limit E of the starting current. The starting current I is limited to about half of the demagnetization limit of 1000 A. The branch of the desired characteristic line S representative of this is labelled "I".

The branch 11 joins the desired characteristic line in the middle speed range. This branch 11 is selected depending on the commutation limit K, i.e., with consideration for the permissible, brush arcing-induced wear values. The temperature of the starter motor 3 and the internal combustion engine 2 can be incorporated here as well, to realize thermal overload protection for the starter motor 3, for example.

Finally, in the highest-speed range, the desired characteristic line S is selected so that a certain margin of safety remains from the mechanical limit M (refer to branch III of the desired characteristic line S).

If a starting process is carried out using such a desired characteristic line S, the starting behavior of the starter motor 3 and the internal combustion engine 2 can be registered via the engine-management electronics. If problems occur, the characteristic line values and selection can be changed in order to realize an improvement during the next starting process. If the engine does not start, an attempt can be made to repeat the start using improved parameters.

What is claimed is:

1. A starter device for an internal combustion engine comprising an electric starter motor (3), a power supply (16) for the starter motor (3), an activating unit (4) for the starter motor (3),
wherein
the activating unit (4) comprises
circuit-breaker electronics (6),
a control unit (5), the control output (8) of which is connected to the control input (9) of the circuit-breaker electronics (6), and
sensors (11, 12, 13, 15, 20) connected to the inputs (10) of the control unit (5) for registering physical parameters relevant to the starting power of the starter motor (3), wherein the control unit (5) optimizes and maximizes, in particular the start characteristic line (5) for activation of the starter motor (3) within the permissible limit values (E, M, K) of the physical parameters based on the parameters registered by the sensors (11, 12, 13, 15, 20).

2. The starter device according to claim 1, wherein the start characteristic line (3) is adaptable in such a fashion that the characteristic line values are adjustable to specified values within the permissible limit values (E, M, K) of the physical parameters.

3. The starter device according to claim 1, wherein a first temperature sensor (11) is provided to register the temperature of the internal combustion engine (2) as a physical parameter.

4. The starter device according to claim 1, wherein a second temperature sensor (2) is provided to register the temperature of the starter motor (3) as a physical parameter.

5. The starter device according to claim 1, wherein an ammeter (13) is provided as a sensor to register the current flowing through the starter motor (3) during the starting process as a physical parameter.

6. The starter device according to claim 1, wherein a torque sensor (15) is provided to register the torque (M) produced by the starter motor (3) during the starting process as a physical parameter.

7. The starter device according to claim 1, wherein a speed sensor (20) is provided to register the speed ($n_{KW}$) at which the starter motor (3) turns during the starting process as a physical parameter.

8. The starter device according to claim 1, wherein the start characteristic line (5) is adaptable in the low-speed range to limit starting current/torque depending on the permissible demagnetization limit (E) of the starter motor magnets.

9. The starter device according to claim 1, wherein the start characteristic line (5) is adaptable in the middle-speed range to limit starting current/torque depending on the permissible, brush arcing-induced wear values, the starter temperature and/or the temperature of the internal combustion engine (2).

10. The starter device according to claim 1, wherein the start characteristic line (5) is adaptable in the high-speed range to limit starting current/torque depending on the permissible, centrifugal force-induced, mechanical limit values (M) of the starter motor (3).

11. The starter device according to claim 1, wherein the engine-starting sequence is registerable by the control unit (5), and the characteristic line values are modifiable, particularly in terms of improving the next engine-starting sequence.

* * * * *